US005470026A

United States Patent [19]

Kotzur

[11] Patent Number: 5,470,026

[45] Date of Patent: Nov. 28, 1995

[54] UNIFORM WIDTH PAYOUT HOLE

[75] Inventor: Frank W. Kotzur, Carmel, N.Y.

[73] Assignee: Windings, Inc., Patterson, N.Y.

[21] Appl. No.: 130,547

[22] Filed: Oct. 1, 1993

[51] Int. Cl.[6] ..... B65H 67/044; B65H 18/28

[52] U.S. Cl. ..... 242/18 R; 242/163

[58] Field of Search ..... 242/18 R, 43, 242/163

[56] References Cited

U.S. PATENT DOCUMENTS

| | | | |
|---|---|---|---|
| 2,634,922 | 4/1953 | Taylor, Jr. | 242/163 |
| 3,061,238 | 10/1962 | Taylor, Jr. | 242/163 |
| 3,178,130 | 4/1965 | Taylor, Jr. | 242/18 R |
| 3,655,140 | 4/1972 | Gordon et al. | 242/18 R |
| 3,747,861 | 7/1973 | Wagner et al. . | |
| 4,085,902 | 4/1978 | Wagner | 242/18 R |
| 4,406,419 | 9/1983 | Kotzur . | |
| 4,523,723 | 6/1985 | Kotzur . | |
| 4,884,764 | 12/1989 | Hill | 242/18 R |

*Primary Examiner*—John M. Jillions
*Assistant Examiner*—Michael R. Mansen
*Attorney, Agent, or Firm*—Watson, Cole, Grindle & Watson

[57] ABSTRACT

Method and apparatus for winding filamentary on a mandrel rotatable about a spindle axis of rotation and a traverse reciprocating with respect to the mandrel to wind the filamentary material in a figure 8 coil configuration with a payout hole extending radially from the inner to the outer wind of the coil; controlling the rotation of the mandrel about the spindle axis of rotation; controlling the reciprocating movement of the traverse with respect to the rotation of the mandrel to wind the filamentary material on the mandrel in the coil of a figure 8 configuration to form the radial payout hole having a substantially constant diameter.

16 Claims, 13 Drawing Sheets

UNIFORM WIDTH PAYOUT HOLE

BACKGROUND OF THE INVENTION

1. Field of the Invention

This invention relates to the winding of filamentary material in a figure 8 configuration with a radial payout hole extending from the inside to the outside of the wind, and more particularly to such winding in which a uniform radial payout hole is produced regardless of the diameter or thickness of the wind.

2. Related Art

Method and apparatus for producing a figure 8 wind with a radial payout hole extending through the wall of the wind is disclosed in U.S. Pat. No. 4,406,419, entitled: "Method and Apparatus for Winding Flexible Material" and assigned to the same assignee as the subject application. The winding techniques disclosed in the aforesaid patent are used by the assignee, Windings, Inc., along with other winding techniques, to produce winds of the aforementioned kind in accordance with the REELEX system, which is licensed in the United States and foreign countries.

In accordance with the currently used REELEX system a coil of filamentary material is wound on a mandrel 20 having a radius $r_2$, and with a radial payout hole in the form of a wedge 22 of essentially constant angle A along the radius of the wind 24, as shown in FIG. 1. It is evident that the generation of a payout hole 22 using a constant angle A results in an increasing circumferential distance in direct proportion to the radius of the wind. This difference in circumferential distance is evident from a consideration of a wind having a radius $r_1$ which results in the distance B being subtended as, for example, by the radius $r_2$ of the mandrel itself (in effect a zero radius wind) which subtends a distance C. Thus if the coil is wound with an initial size of the payout hole 22 equal to allow a payout tube to be inserted therein after the wind is completed, it is apparent that the size of the payout hole 22 will be too large when the wind is finished with a radius of $r_1$. It is therefore desirable to provide a technique for modifying or adjusting the size of the payout hole during the winding of a coil, and especially for larger diameter coils where the inner and outer size of the payout holes have greater disparity (for example, compare distances B and C of FIG. 1).

The problems caused by such a payout hole are as follows:

(1) When producing coils in accordance with the REELEX system, a "valley" is generated where there are no crossovers. This causes the coil to become lumpy due to the varying densities of the wound filamentary material. The valleys extend outwardly from the payout hole, around the circumference, and terminate at the sides of the coil 180 degrees from the hole. This causes lumpiness in the surface of the coil, which defect becomes exaggerated as the coil diameter increases and as the hole becomes larger. FIG. 2 shows a coil winding layer laid out flat with the valleys and the payout hole designated as such.

U.S. Pat. No. 4,523,723, entitled: Winding Flexible Material with Layer Shifting and also assigned to Windings, Inc. discloses a method of winding flexible material more densely by varying the speed of the traverse or the speed of the mandrel with respect to one another. The patent also includes Figures with flattened windings similar to that of FIG. 2 herein. However, the techniques disclosed in this patent do not overcome the problem of the wedge-shaped payout hole as defined above.

(2) The lumpiness causes slippage of the winds that often obscures the payout hole. To overcome this problem, the hole size is often increased, which makes the problem of slippage worse and also lowers the density of the wind even further.

(3) The package (which is usually, but not always, a box-like container) must be made larger to accommodate the lumps 26, 27 as illustrated in FIG. 4, where it can be seen that if the high points 28 in the wind 30 were not present, the box or container dimension could be smaller if the wind were produced without the high points 28.

(4) Since the payout hole uses up some circumference of the coil, the larger the hole is, the larger the coil will be.

FIGS. 5*a* and 5*b* illustrate the problem of the wasted space 33 produced by a payout hole 32 in a winding 34 made with constant angle as shown in FIG. 5*a*, and the lack of wasted space produced by a payout hole 35 made in a winding 36 with a constant circumference or diameter as shown in FIG. 5*b*. In FIG. 5*a* wasted space 33 is formed between payout tube 37 and the side 38 of the payout hole 32. In FIG. 5*b* payout tube 40 fits neatly within payout hole 35 formed with substantially parallel sides (constant diameter). The constant width payout hole 35 in FIG. 5*b* is formed by starting the wind with a given angle and varying the angle as the coil diameter increases. Coil densities can be increased by as much as 7% due to the increase in available circumference. This translates to about 0.5 inch of coil diameter for 18 inch diameter coils. The savings due to the decrease in the package size because of the reduction in the "lumpiness" is even higher.

In order to produce the desired effect of a "constant" hole, the hole must first be straightened. If the hole were allowed to be formed without straightening, the actual formation would look like FIGS. 5*c* and 5*d*, which show constant angle, and FIGS. 5*e* and 5*f*, which show constant size. The important points that are illustrated in these Figures is that the twisted payout hole forces the payout tube (guide) to lie in some orientation other than along a radial (FIG. 5*c*). To insure that the payout tube is oriented properly, the payout hole must be made larger. FIGS. 5*e* and 5*f* show the same problem, but with less wasted space. In order to receive the full benefit from this process, the payout hole must be straight (along radials) and of constant size.

U.S. Pat. No. 3,747,861, entitled: Apparatus and Method for Winding Flexible Material for Twistless Payout Through a Straight Radial Opening discloses a technique for straightening the payout hole by adjusting the speed of the traverse or mechanically shifting the spindle. In the apparatus of the aforementioned patent, the mechanism that causes the payout to shift in the first instance is the result of the motion of the traverse in a direction away from the spindle shaft and the motion of the traverse away from the spindle shaft and through an arc. This movement causes the payout hole to curve in a direction opposite to that of the rotation of the spindle. Because of the cost and complexity of such bailing techniques, REELEX systems have never employed commercial or industrial winding machines that use such a bailing technique.

In the REELEX system, properly formed endforms and mandrels are used with a traverse that is stationary, i.e. does not move in a direction perpendicular to the shaft of the spindle (for example, see the aforementioned U.S. Pat. No. 4,406,419). When the traverse remains a fixed distance from the spindle shaft axis or mandrel surface, a different situation occurs than when the traverse does not remain a fixed distance from the spindle shaft axis. In the former situation, as the coil is wound, the increase in diameter causes the surface of the coil to move toward the traverse, which has the affect of laying the material down sooner then the preceding layer. This results in a slight positive shift in phase from layer to layer, causing among other things, a tilted payout hole. But in this case the payout hole shifts in the same direction as the spindle rotation. This positive advance from layer to layer as the coil builds in diameter may be counteracted by introducing a product diameter input into the winding microprocessor. The technique uses an algorithm that calculates the theoretical diameter of the coil at each layer (as opposed to actually sensing the diameter), and determines the amount of phase shift that should have occurred. The winding algorithm then causes a corresponding minus shift of the payout hole and the whole layer of the wind. The shift always occurs to the side of the payout hole that the layer is approaching and never to the side of the payout hole that has just occurred.

For minus gain or advance the approach is to the zero side, and for the plus gain or advance it is the NOT HOLE SIZE—360 degrees minus the HOLE SIZE. The resulting straight hole can be reduced in overall size because the payout tube can be inserted straight in and remain in a radial line. Because of this reduction in the constant angle of the hole size, there is a corresponding reduction in the size of the package. This, plus the constant circumference process discussed above, will result in the overall reduction in coil diameters of more than an inch for larger diameter coils, such as 18 inch coils.

SUMMARY OF THE INVENTION

A primary object of the present invention is to provide a method of overcoming or eliminating the above-described disadvantages of producing wound coils in general, and specifically when such coils are wound in accordance with the REELEX system. Thus, the method of the present invention is to reduce or eliminate "valleys" and therefore the lumpiness of wound coils to produce payout holes of a more consistent diameter. Commensurate with the decrease in the lumpiness of the wound coil is a reduction in the overall diameter of the wound coil (for a given wind), thereby resulting in a decreased overall diameter coil that can be packaged in a smaller container. Finally, maintaining the desired diameter payout hole results in a smaller circumference wind, thereby also attributing to a smaller diameter coil because increasing the size of the payout hole diameter as the coil is wound causes increasing circumference of the wind.

In one embodiment of the invention, the aforementioned features, advantages and objects of the invention are obtained by the use of sensors to control the size of the payout hole and produce a standard payout hole. This method enables some existing coil winding machines to be modified to control and modify the actual winding of the coil to eliminate the aforementioned disadvantages of wound coils and especially those wound by the REELEX system.

In a modified embodiment also using sensors, the sensors are moved in conjunction with the increase in the diameter of the coil as it is being wound to produce a standard payout hole having the advantages stated above for the present invention.

In yet another embodiment of the invention, and one that can be used with microprocessor control of the winding operation, the location and size of the payout hole is calculated. The proper winding parameters to control the winding process are programmed into the memory of the microprocessor with provision for entry of key variables by means of a key pad, thumbwheel switches or a key board.

The present invention represents an alternative method and apparatus for generating a straight payout hole than that provided by U.S. Pat. No. 3,747,861 and the above-described algorithm as used with the current REELEX system, and generally as described in the aforementioned U.S. Pat. No. 4,406,419.

BRIEF DESCRIPTION OF THE DRAWINGS

The above-described objects, advantages and features of the invention are believed to be readily apparent from a consideration of the following description of preferred embodiments of the invention representing the best mode of carrying out the invention when taken in conjunction with the following drawings, wherein.

DETAILED DESCRIPTION OF THE EMBODIMENTS THE FIRST EMBODIMENT

Figure 6A:
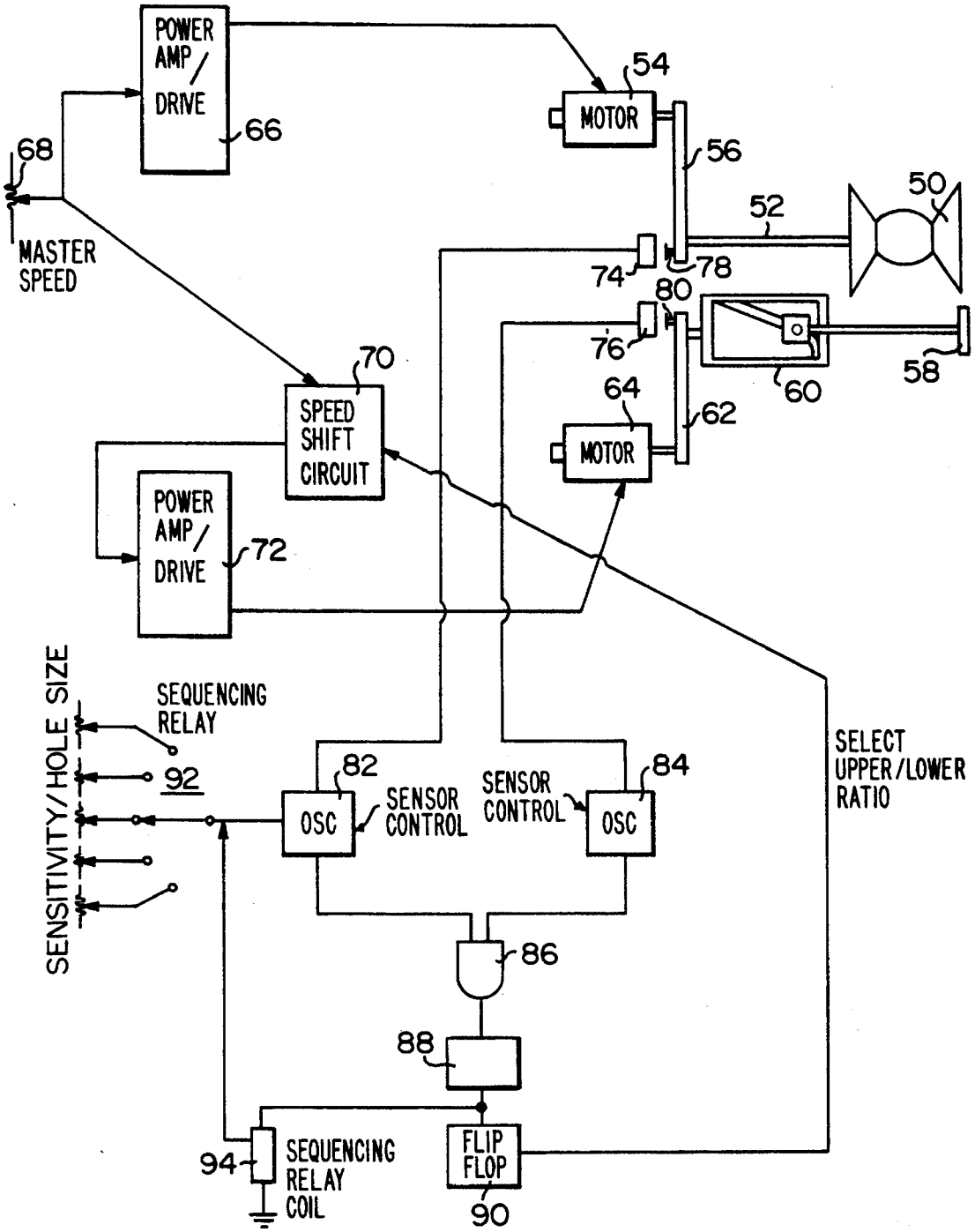
FIG. 6*a* is a combined block diagrammatic, schematic drawing of a first embodiment of apparatus according to the invention for producing a constant diameter or width payout hole in a winding.

FIG. 6*a* shows a first embodiment of apparatus for generating a constant diameter payout hole in a winding and which uses pickup sensors. Winding machines that employ the use of proximity detectors, and the like, to generate payout holes have not been produced in several years in favor of more advanced methods of generating payout holes using microprocessor technology. The method and apparatus of FIG. 6*a* is nevertheless of interest because the earlier winding machines are still in use and generate a standard payout hole as described with respect to FIGS. 1–4 and 5*a*. Although none of these older machines are capable of straightening the hole, such equipment can be retrofitted to incorporate the modification of FIG. 6*a*. The concept of the modification of FIG. 6*a* is that the pickup sensitivity is reduced (for example, perhaps through the use of a sequencing relay or counters and D/A converters from layer to layer of the winding). This makes the hole smaller as the coil builds in diameter.

FIG. 6*a* shows a first embodiment of apparatus according to the invention for producing a constant diameter or width payout hole in a winding. Mandrel 50 is mounted on a spindle axis 52 and is rotated by motor 54 through gear assembly 56 as is known to those skilled in the winding art. Traverse 58 is mounted for reciprocating movement with respect to mandrel 50 under the action of a barrel cam which is actuated by gear assembly 62 driven by motor 64, also in a manner known to those skilled in the winding art. For example, traverse 58 may be caused to move through a distance of one cycle as mandrel 50 is rotated through two rotations to produce a FIG. 8 pattern with a radial payout hole as generally described in the aforementioned U.S. Pat. No. 4,406,419.

Mandrel drive motor 54 is controlled through power amplifier drive circuit 66 from a master speed setting device such as a potentiometer 68. Traverse motor 64 is driven from master speed potentiometer 68 through speed shift circuit 70, which controls power amplifier drive circuit 72 for ultimately controlling the traverse motor 64. Speed shift circuit 70 operates to either speed up or slow down traverse motor 64 to produce either a plus or minus gain, thereby causing the layer of filamentary material being deposited on mandrel 50 to be shifted from its location had the speed of traverse motor 64 remained constant. This distributes the figure 8's around the mandrel. In accordance with the purpose of the present invention it is necessary to cause such layer shifting to produce a substantially constant payout hole width or diameter.

That result is obtained by the use of two sensors 74 and 76, respectively mounted in proximity to detect the rotation of the spindle shaft 52 and the reciprocal movement of the traverse 58. Sensors 74 and 76 may each comprise a well known Hall device which will produce a signal output for each rotation of the spindle axis 52 in the case of sensor 74, and a signal output for each reciprocation of traverse 58 in the case of sensor 76. Alternatively, sensors 74, 76 may each comprise a frequency sensitive oscillator having an oscillator tunable "Q" circuit and which produce a variable frequency output with the rotation of the spindle axis and the reciprocation of the traverse 58. A tunable signal output is obtained from each of oscillator sensors 74, 76 with rotation of the spindle axis and the respective movement of a metallic marker 78 and 80 past ocsillator sensors 74, 76, respectively.

The output of each of oscillator sensors 74, 76 is respectively input to sensor control circuits 82, 84 one of which, for example sensor control circuit 82, is adjustable to provide a detection window that varies the size of the payout hole and detects the movement of the spindle axis 52 and the traverse 58. The output of each of sensor control circuits 82 and 84 is input to a coincidence gate 86. The coincidence of the signal input to coincidence gate 86 is an indication that the relative speed of the traverse 58 with respect to the rotation of the spindle axis 52 must be changed to form the payout hole. The output of coincidence gate 86 is input to a delay break circuit 88, the function of which is to prevent unwanted signals from controlling flip-flop 90. For example, the first coincidence signal from coincidence gate 86 is allowed to pass, however, all signals subsequent to that first coincidence signal are blocked for a fixed, period of time dependent upon the speed of the winding operation. For example, the delay period may be approximately two seconds for a spindle speed of 50 rpm, and can remain such up to 500 rpm for most winding conditions.

The tunable frequency of sensor control circuit 82 is controlled by sequencing relay 92 to cause different resistances to be inserted in the adjustable "Q" circuit of sensor control circuit 82 in accordance with the hole size or diameter of the hole. The sequencing relay coil 94 is controlled by the output of the delay break circuit 88. Thus, as each layer of winding is laid on mandrel 50 and the diameter of the coil being wound thereon increases, the frequency of oscillation of the sensor control circuit is changed to vary the time of coincidence of the output from coincidence gate 86 and therefore the corresponding time of actuation of flip-flop circuit 90. The output of flip-flop 90 selects an upper or lower speed ratio to cause a corresponding shift in the output of speed shift circuit 70, thereby advancing or retarding the gain of the coil winding by controlling the speed of traverse motor 64.

The delay break circuitry 88 is used to prevent multiple coincidence pulses, due to mechanical delays, from erroneously switching between upper/lower winding ratios of the flip-flop circuit that has just flipped.

THE SECOND EMBODIMENT

Figure 6B:
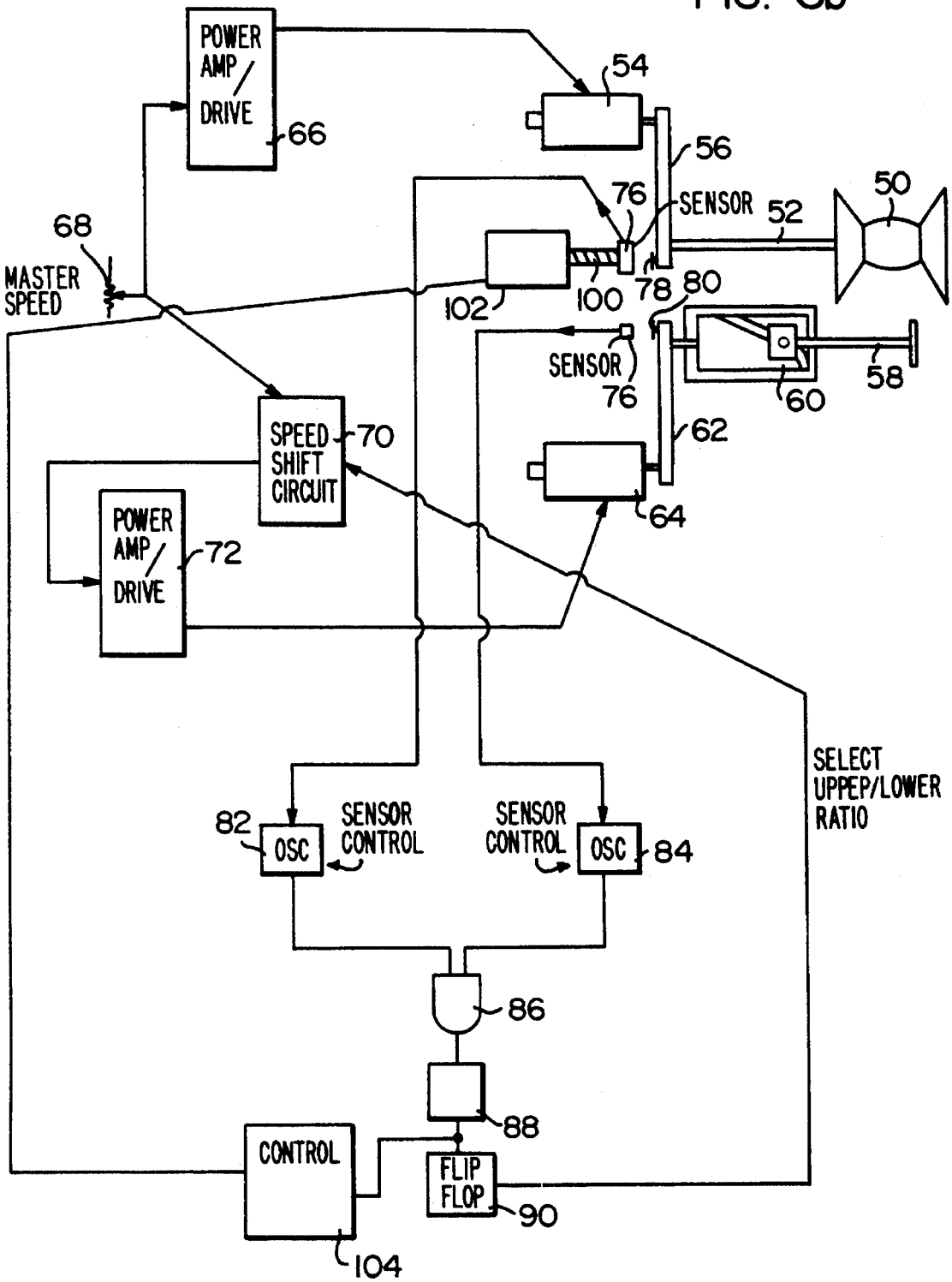
FIG. 6*b* is is a modification of the first embodiment of FIG. 6*a* for producing a constant diameter payout hole in a winding in accordance with the invention.

FIG. 6*b* shows a modification of the embodiment of FIG. 6*a* in which the sensor pickups are physically moved through the use of a ratchet device or a screw device. Each time the pickups are in coincidence the screw is turned a given amount, or the ratchet is moved through the proper number of "clicks" to reduce the sensitivity of the sensor window, thus reducing the size of the payout hole. Such screw devices are available as complete packages for use as linear actuators and come equipped with built-in potentiometers that can provide voltage feedback for more accurate positioning of the pickup.

Thus, with reference to FIG. 6*b*, sensor 74 for sensing the movement of the spindle axis 52 is mounted on screw/ratchet assembly 100 driven by motor 102 so that sensor 74 is driven toward or away from sensor actuator 78 depending upon the direction of rotation of motor 102. Motor 102 may be either a step motor or a DC motor and is controlled by the digital or analog output of control circuit 104. If motor 102 is a step motor, then the output of control circuit 104 is digital, and if motor 102 is a DC motor, then the output of control circuit 104 is a DC control signal. Control circuit 104 is actuated by the output of delay break circuit 88 and the remainder of the circuitry in FIG. 6*b* operates in the same manner as the corresponding circuitry of FIG. 6*a* as described above. However, the sensor control circuitry is modified to the extent that frequency oscillator sensor circuit 82' has a fixed, rather than a variable, sensor frequency.

The delay break circuitry 88 performs the same function as described above with respect to FIG. 6*a*.

THE THIRD EMBODIMENT

Figure 7:
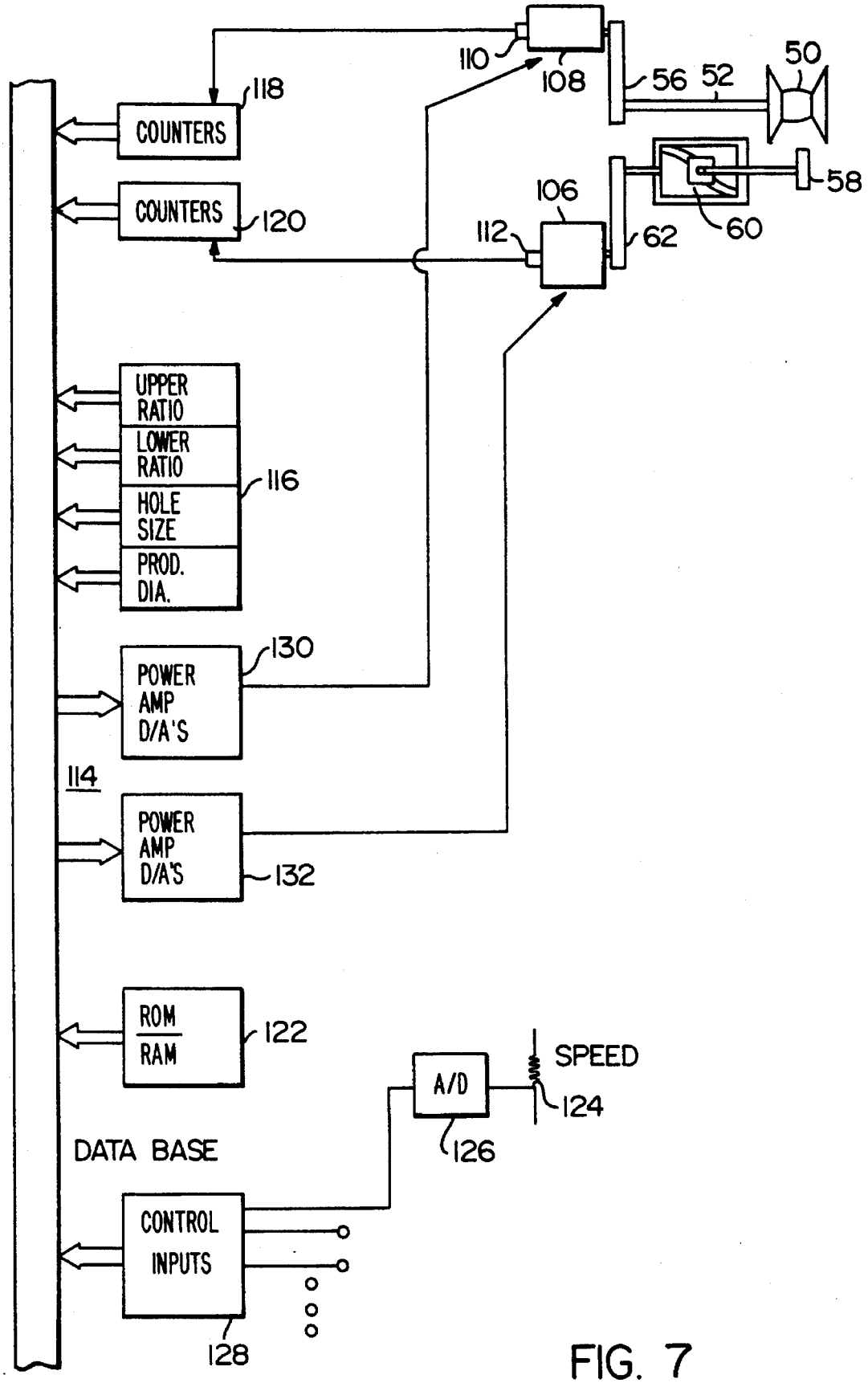
FIG. 7 is a combined block diagrammatic, schematic drawing of a second embodiment according to the invention for generating a constant diameter payout hole in a winding using a microprocessor.

The FIG. 7 embodiment uses microprocessor technology for calculating the initial location and size of the payout hole and as the winding is being wound. This method produces a more accurate size and location of the payout holes than do the embodiments of FIGS. 6*a* and 6*b* and does not require any extra hardware, as it simply uses software to perform the function of adjusting the hole size as the winding of the coil progresses.

With reference to FIG. 7, the winding process involves a motor 108 for driving the spindle 52, such as a DC motor and drive, as well as a motor 106 for driving the traverse 58, such as another DC motor and drive, which components are already used in current REELEX systems. Each motor 106, 108 has a respective encoder 110, 112 mounted to it to allow the microprocessor 114 to know the exact angular location of the spindle shaft 52 and the position of the traverse 58. The encoders 110, 112 can be respectively mounted on the motors 108, 106, and with properly scaled counting circuits 118, 120, the respective gear ratios between the respective motor and the spindle shaft and traverse movement can be taken into account. The process for generating a constant diameter payout hole is programmed into the microprocessor memory, such as ROM/RAM 122 with certain winding parameter variables such as upper ratio, lower ratio, hole size and product diameter input through a key pad, thumbwheel switches, or a key board (collectively designated as component 116 in FIG. 7). The desired size of payout hole opening is entered as the "HOLE SIZE" and the parameter, the "PRODUCT DIAMETER" is also entered. The desired winding speed for the REELEX wind is inserted through potentiometer 124, and through analog/digital converter 126 is input through control input circuit 128 to the microprocessor 114. As the spindle motor 108 turns, the microprocessor 114 tracks the spindle 52 location as well as the location of the traverse 58. The microprocessor ultimately generates voltage outputs that correspond to the error between the actual location of the traverse 58 and the desired calculated location of the traverse 58 to produce a REELEX coil having a substantially constant diameter or payout hole size by controlling power amplifier digital/analog converters 130, 132 that respectively control spindle drive motor 108 and traverse motor drive 106.

The complete algorithm programmed into microprocessor 114 for winding a complete REELEX wind is not that important for the purposes of the present invention, but the following is a description of an algorithm for the formation of the payout hole.

Figure 8:
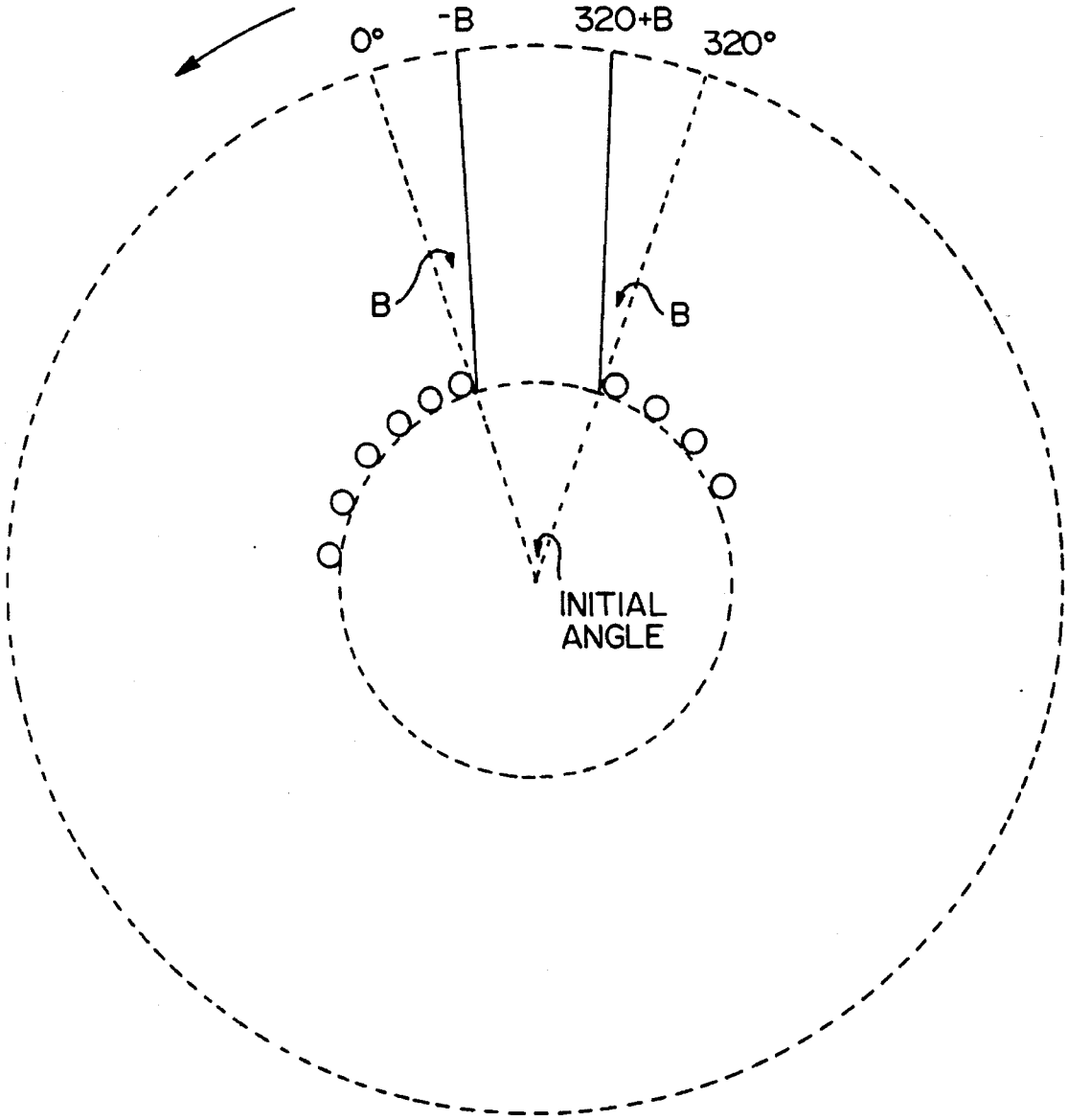
FIG. 8 illustrates the principle of generating a constant diameter payout hole in accordance with the method of the invention.

The initial payout hole size is entered. If, for instance, the starting hole size is 40 degrees, the microprocessor 114 will lay filamentary material down for 320 degrees as shown in FIG. 8, i.e. the computer controls the winding of material on the surface of the mandrel from 0 to 320 degrees. If the payout hole diameter is to be reduced to cause it to be constant for the payout tube, the payout hole diameter must be reduced on both sides. In other words, the NOT HOLE SIZE must be increased from 320 degrees to some higher amount (such as 321, 322, ...) and the zero location must be reduced to a lower amount such as −1, −2, ..., which is the same as 359, 358, ... degrees). The final reduction is shown as B in FIG. 8. The rate of increase in NOT HOLE SIZE (or decrease in the payout hole size) is dependent on the initial size of the payout hole and the diameter of the filamentary material being wound.

Figure 1:
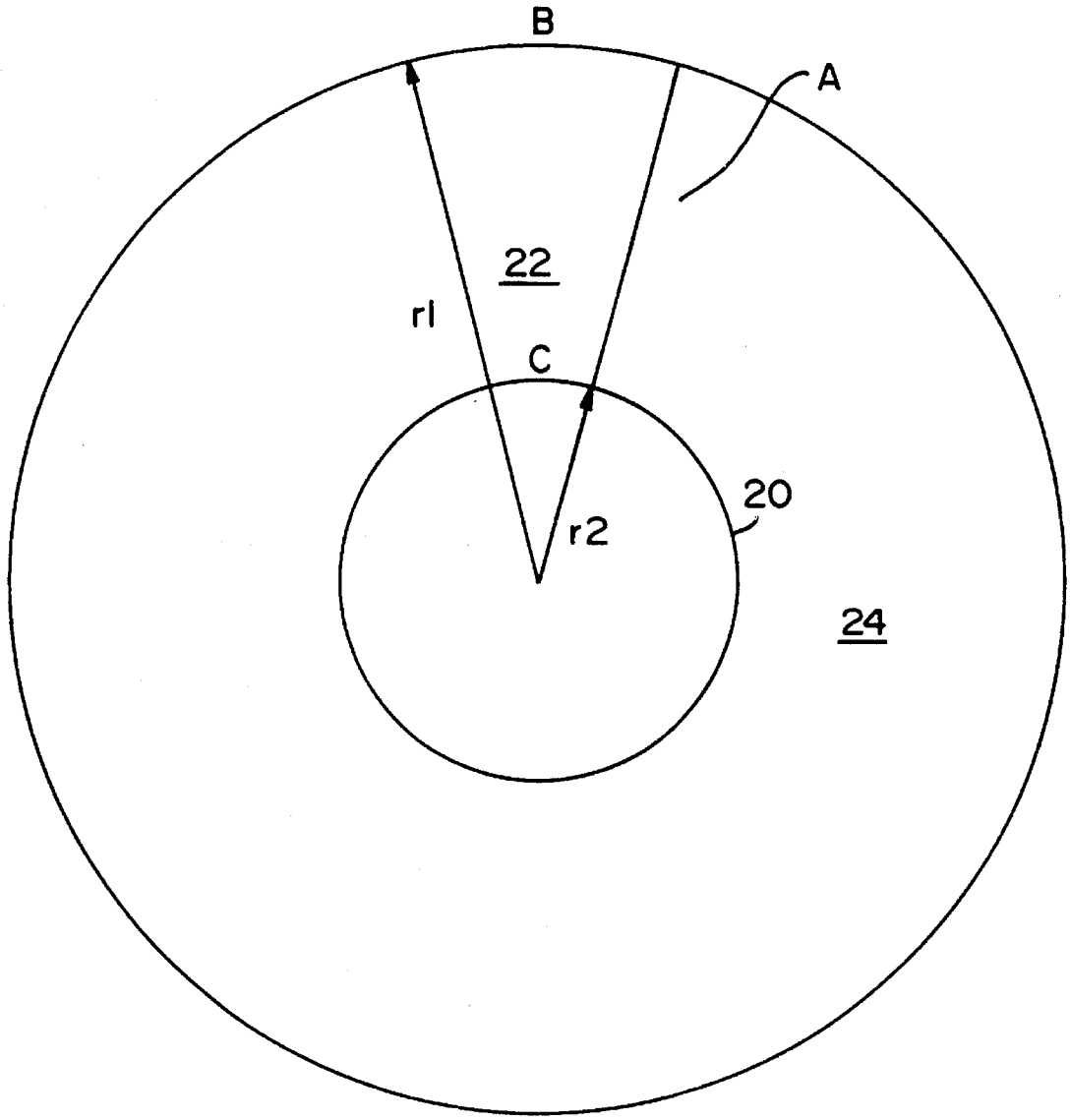
FIG. 1 PRIOR ART
FIG. 1 illustrates the affect of the increasing size in the effective diameter of a payout hole in a wound coil as generated without compensation in a REELEX system.
Figure 2:
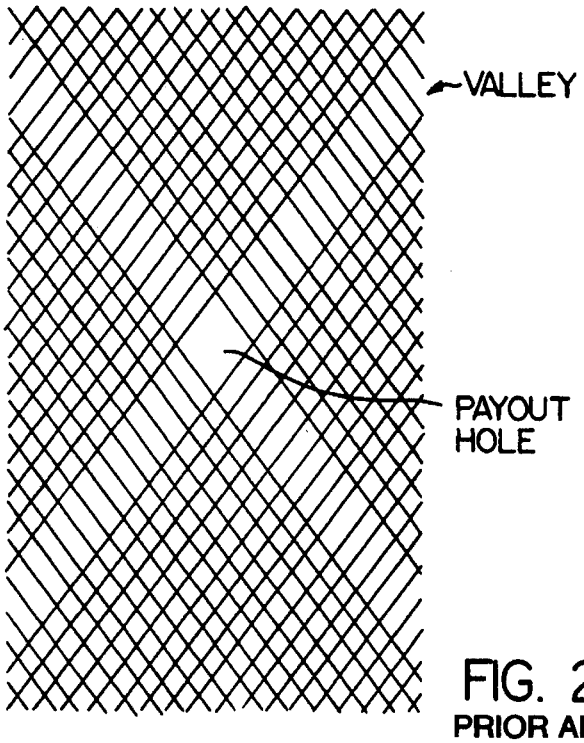
FIG. 2 PRIOR ART
FIG. 2 shows the production of a valley and a payout hole in a winding.
Figure 3:
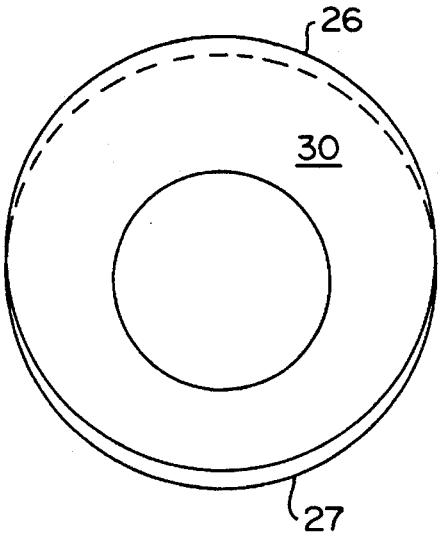
FIG. 3 PRIOR ART
FIG. 3 shows the effective increase in diameter and the lumpiness of a wound coil resulting from an increase in the diameter of the payout hole as the coil is wound.
Figure 4:
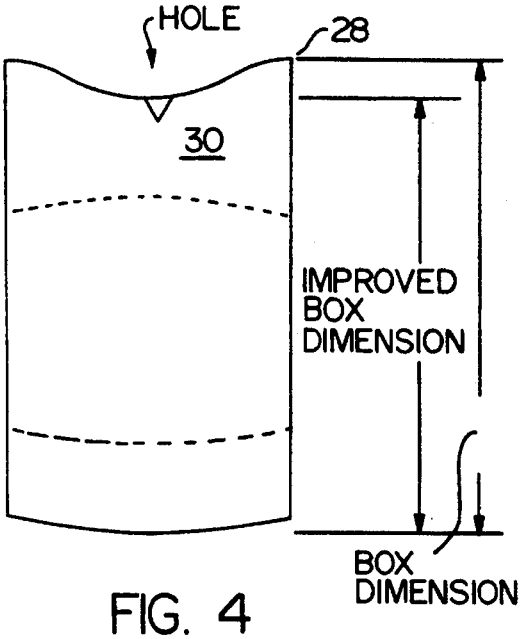
FIG. 4 PRIOR ART
FIG. 4 illustrates the effect of the irregularity of the wound coil on increasing the size of the coil container.
Figure 5A:
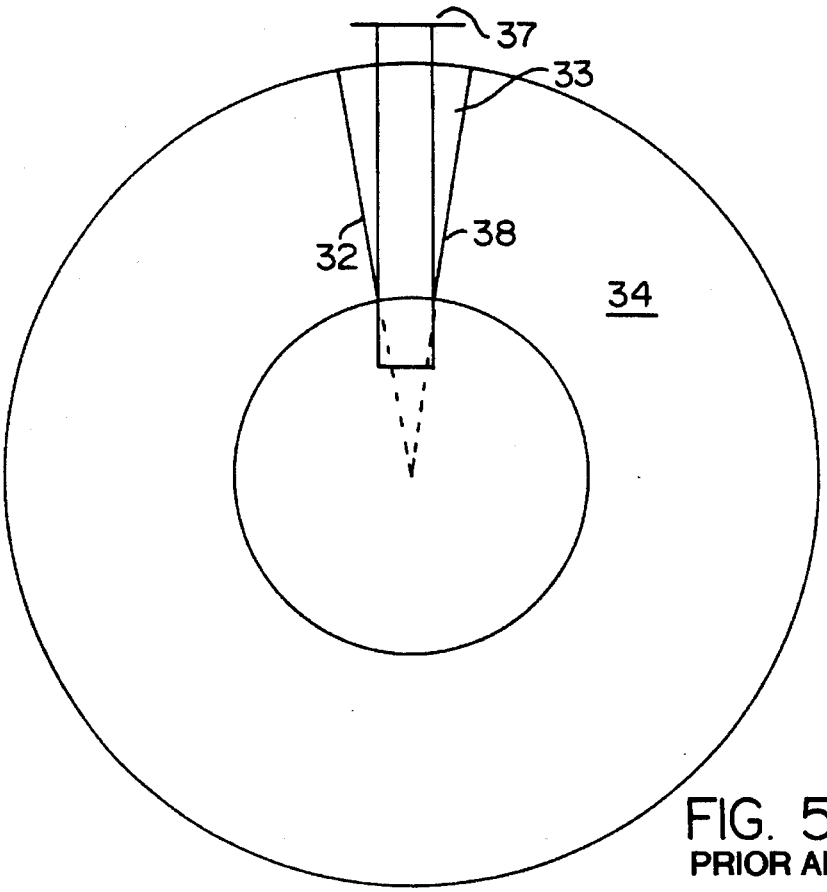
FIG. 5a PRIOR ART
FIG. 5*a* shows the wasted space produced in the payout hole between the sides of the payout tube and the sides of the payout hole using a constant angle and compensated for tilt for generating the payout hole.
Figure 5B:
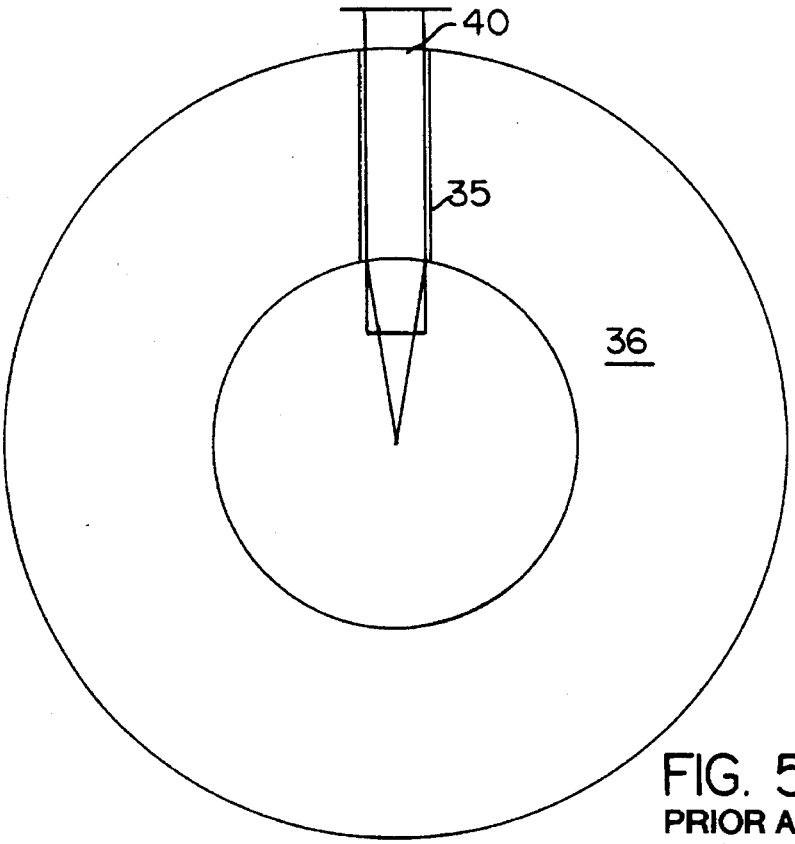
FIG. 5b PRIOR ART
FIG. 5*b* illustrates the improvement in the fit of the payout tube of a given diameter with a payout hole generated using a constant size (diameter) for generating the payout hole and also for tilt adjustment.
Figure 5C:
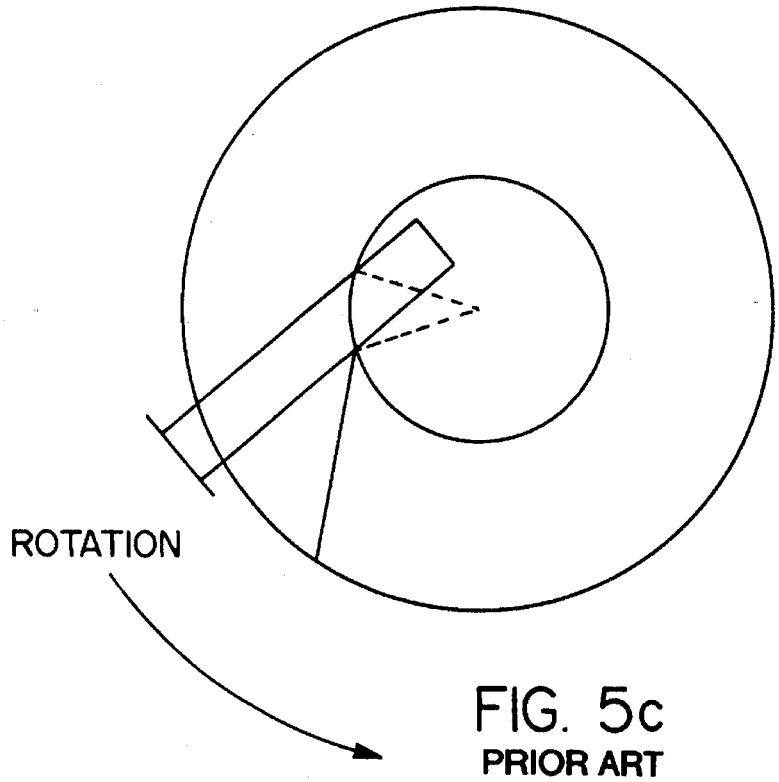
FIG. 5c PRIOR ART
FIG. 5*c* shows a cross-section of a winding with a payout hole in which the payout tube is made with a constant angle, thereby producing a payout hole and a payout tube inserted therein that is not aligned with a radial of the winding.
Figure 5D:
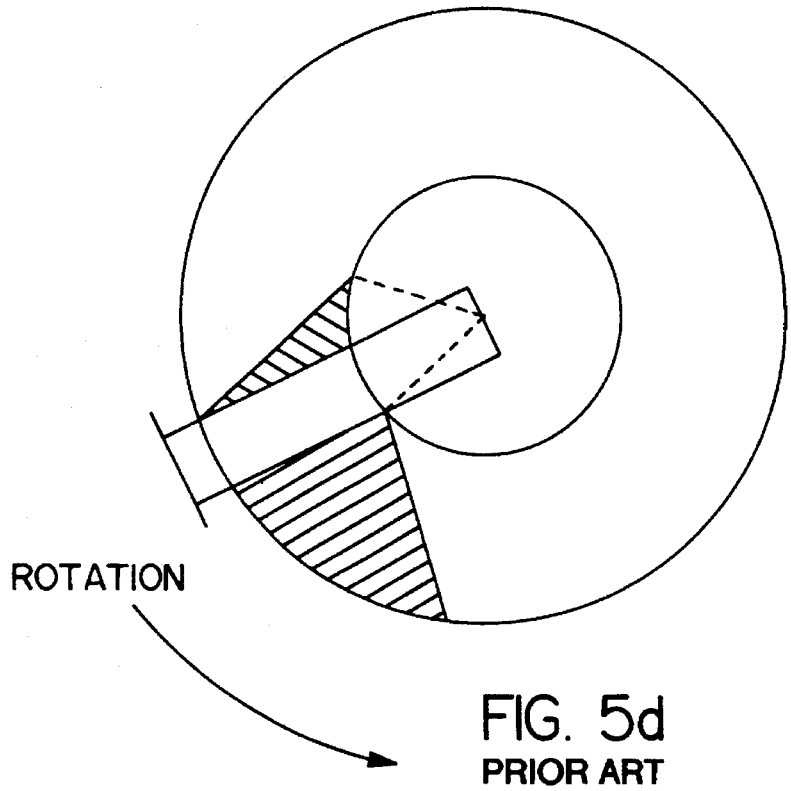
FIG. 5d PRIOR ART
FIG. 5*d* illustrates a cross-section of the winding of FIG. 5*c* with the size of the payout hole enlarged to allow the payout tube to be properly oriented.
Figure 5E:
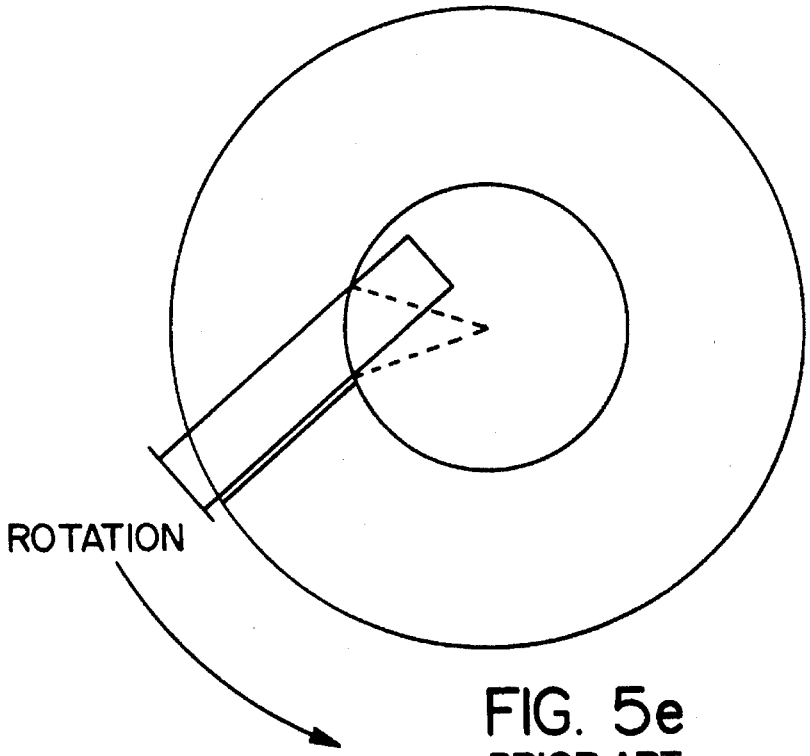
FIG. 5e PRIOR ART
FIG. 5*e* shows a cross-section of a winding with a payout hole made in accordance with the invention; however the payout tube is improperly aligned therewith.
Figure 5F:
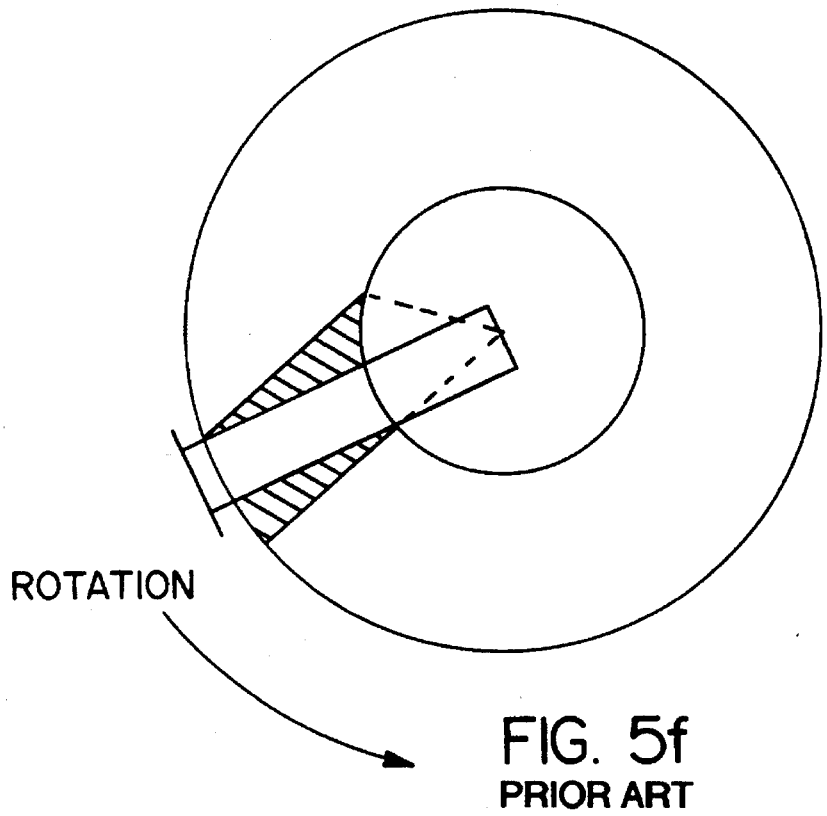
FIG. 5f PRIOR ART
FIG. 5*f* illustrates a cross-section of the winding of FIG. 5*e* but with the payout tube properly aligned by increasing the angle of the payout hole during the winding process.

The constant size diameter payout hole shown in FIG. 5*b* is somewhat misleading because the concept of a payout hole having a constant circumference can not really be achieved using the current REELEX system because the coil width and diameter change in such a way to force the cross-over angle to decrease from layer to layer. What is actually being kept constant is the distance between the strands of material that are tangent to the payout hole as the coil is being wound.

Figure 9:
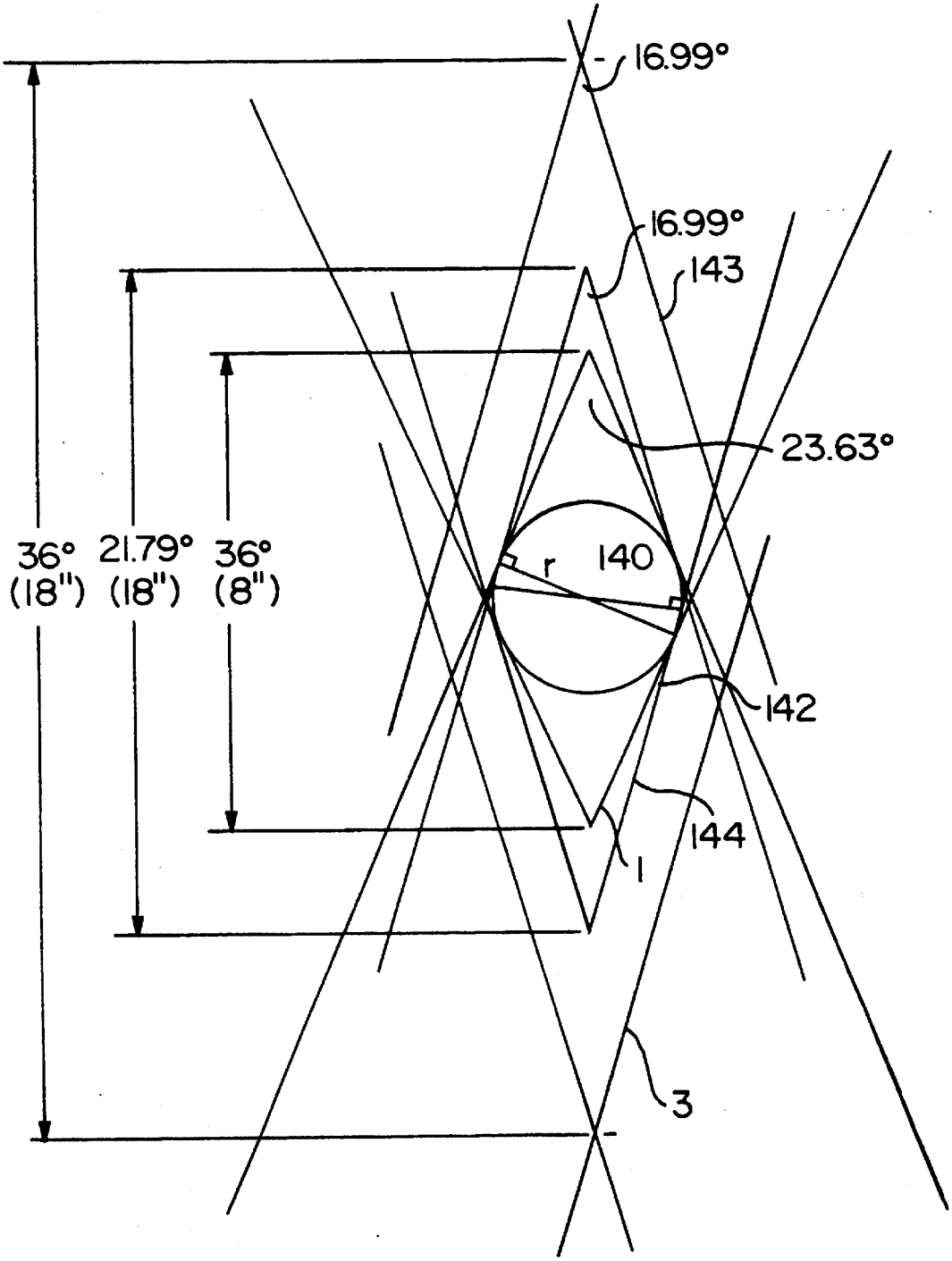
FIG. 9 illustrates another principle of operation of the method of the invention for maintaining constant the distance between the strands of material that are tangent to the payout tube.

FIG. 9 illustrates this latter concept of maintaining constant the distance between the strands of material that are tangent to the payout hole. Three general payout holes are illustrated in FIG. 9, which payout holes are laid out in a plane, with a circle representing a payout tube 140. The diamonds 142, 143 indicated in bold lines, represent a payout hole with a 36 degree opening. The inner diamond 142 is the size of an 8 inch mandrel and the outer diamond 143 is the size of an 18 inch diameter winding. However, payout hole 142 is made in accordance with the constant diameter concept of the present invention and payout hole 143 is not. It is to be noted that the larger diamond 143 does not touch the payout tube 140, whereas payout hole 142 is in contact with the payout tube 140.

The following is a description of the relationships involved between the various winding parameters. The exact ratios of width (W) to length (L) of the payout hole (see FIG. 10) are dependent on the angle a and the diameter of the coil (or layer). The following variables and constants are used in the formulas discussed herein.

| | |
|---|---|
| $P_o$ = initial payout hole size | w = W/2 |
| P = Payout hole size | r = Radius of payout tube |
| Mw = Mandrel width | L = Length of payout hole |
| D = Mandrel/coil diameter | H = L/2 |
| W = Width of payout hole | a = Angle between wound material and centerline of coil at the payout hole |

Figure 11:
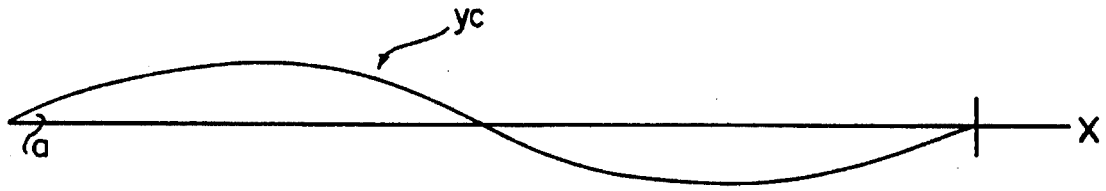
FIG. 11 is a graph of the coil pattern vs. distance of the spindle for an arbitrary traverse motion.

In the description of a first example of the operation of the constant diameter payout hole in accordance with the invention, it is assumed that the traverse output is sinusoidal such that the coil pattern is also sinusoidal. The sinusoidal displacement is shown in FIG. 11 and is defined by the following equation:

$Y_c$=(Mw/2) Sin {x/D }, where $Y_c$ is defined as the traverse displacement.

(EQ 1) $a = \tan^{-1}(y'_c)$, where $y'_c = dy_c/dx$
$y'_c = (Mw/2D) \cos \{ x/D \}$
$y'_c = Mw/2D$ for $x = 0$ The angle a is found from the first derivative of the first equation above defining the coil pattern. The simple derivation is shown starting from EQ 1. For a typical coil wound on a mandrel that has a diameter of 8 inches, the angle a is 23.63 degrees and for a coil of 18 inches, the angle a is 16.99 degrees.

These angles are calculated as follows:

For 8 inch mandrel/coil:=$\tan^{-1}$\{3.5/8\}=23.63 degrees

For 18 inch mandrel/coil:=$\tan^{-1}$\{5.5/18\}=16.99 degrees

Figure 10:
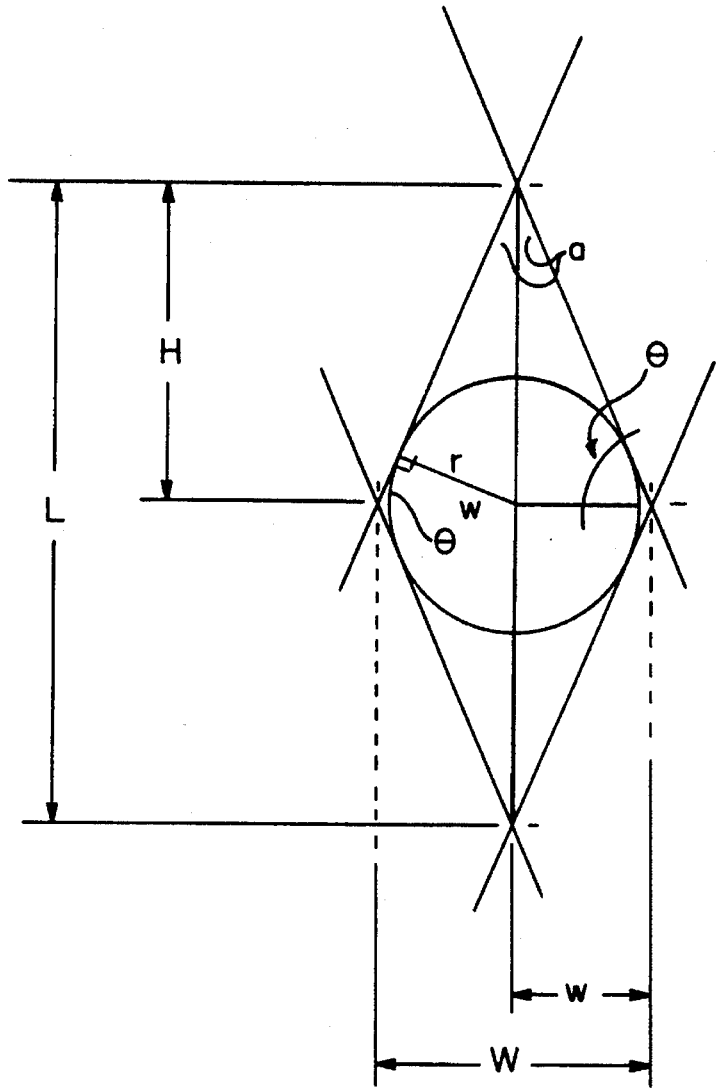
FIG. 10 shows the relationship between various parameters involved in generating a constant diameter payout hole during winding of a coil.

With reference to FIG. 10, if L is known (or calculated) and the coil diameter D is known, then the payout hole angle is:

(EQ 2) P=360 (L/D)

Solving for L and from FIG. 10:

Sin 0=r/ (0=90–a), where from EQ 1, a=$\tan^{-1}$ {Mw/2} from x=0 =r/sin 0; H=tan 0 L=2H=2 tan0=2 Tan {90–$\tan^{-1}$ (Mw/D)} (EQ 3)=(2rtan {90–$\tan^{-1}$ (Mw/D)})/sin {90–$\tan^{-1}$ (Mw/D)} =2r/cos {90–$\tan^{-1}$ (Mw/D)} therefore:

(EQ 4) P=(720r)/ DCos {90–$\tan^{-1}$ (Mw/D)}// (EQ 5) r=D cos {90–$\tan^{-1}$ (Mw/D)}/720

Using the angles calculated above in (EQ 4) and with a 1 inch payout tube (r=0.5), the minimum angle for a payout hole is calculated to be 36 degrees. If the diameter of the wound material is taken in to account the hole size must increase. If a 0.25 inch diameter material is assumed, the minimum payout hole increases to 39.33 degrees. For the following description the centerline of the material will be considered. The angle of 36 degrees is the opening that must be left on the surface of the 8 inch mandrel to receive a 1 inch diameter tube. Because of the decrease in the angle a with coil diameter, the size of the hole can not decrease proportionally with coil diameter. That is, even though the finished coil is 18 inches, or 2.25 times larger than the mandrel, the hole can not be decreased to 16 degrees (36 degrees divided by 2.25). Instead the formula must be used using Mw=5.5 and D=18. This yields a finished hole of 21.79 degrees. If the computer controlling the winding process is programmed to solve (EQ 4), using the coil diameter as a variable, which can be calculated from the product diameter and the number of layers wound, the difference between the starting payout hole and the payout hole for the current layer can be calculated. Then, by dividing this amount by 2 and adding the result to the upper limit of NOT HOLE SIZE and subtracting that result from zero (the lower limit of NOT HOLE SIZE), the payout hole will be kept at a constant width to receive the payout tube.

(EQ 4) shows the relationship between the hole size and the mandrel width, coil diameter and the tube radius. The current REELEX machines (Roughly configured as shown in FIG. 7) do not calculate the length L of the payout tube or the hole size P. Instead, the initial hole size Po is input and, when a new coil winding is started, the REELEX machines calculate the radius r of the payout tube based on the value of the hole size (P), and the constants Mw and D (EQ 5). Once r is known, (EQ 4) is used with the diameter D of the mandrel/coil as the variable. With each layer of wound filamentary material, the value of D is increased by two times the filamentary material diameter (size). The computer knows when a layer is completed because it controls the formation of the payout hole.

Figure 12:
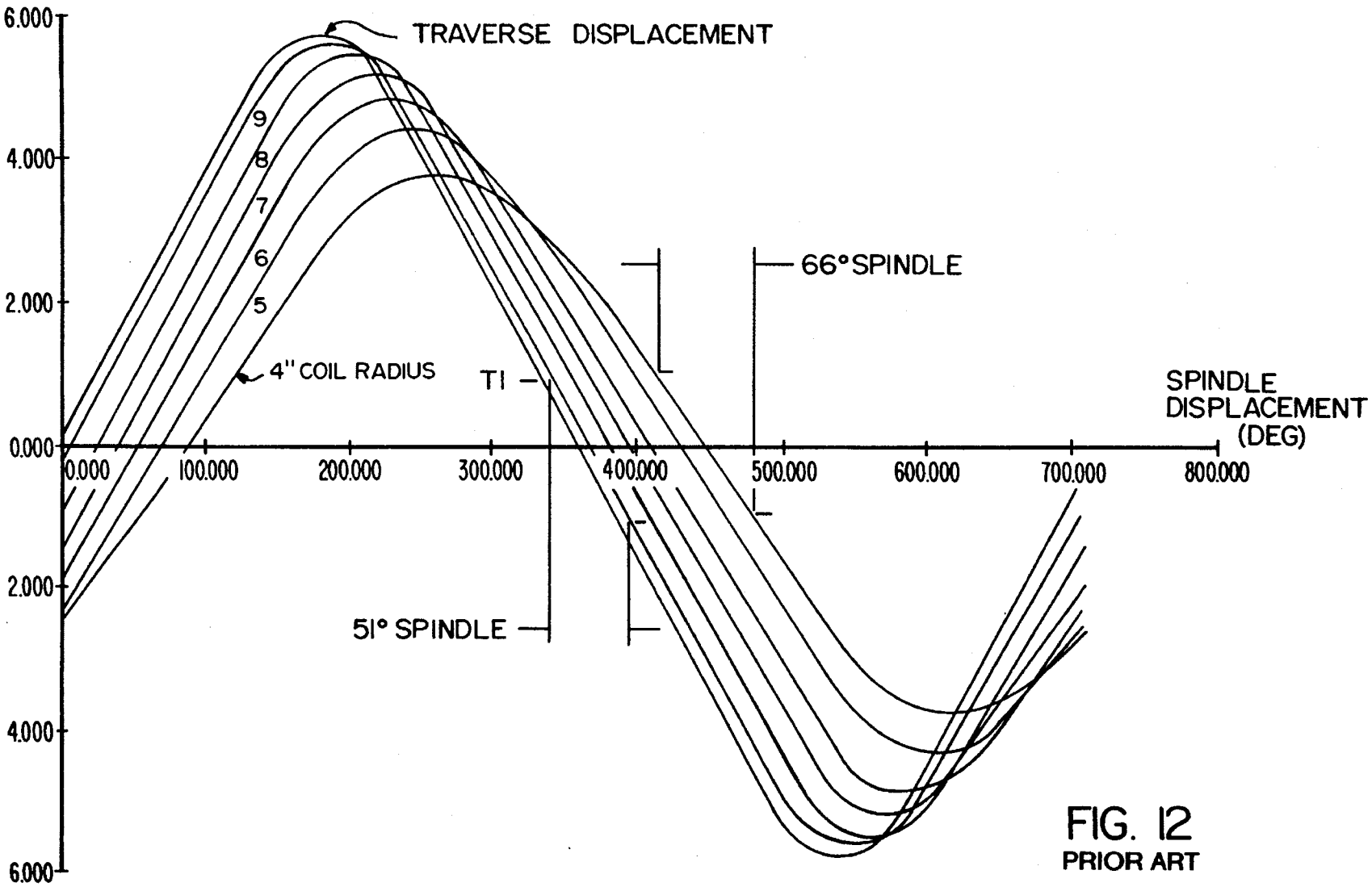
FIG. 12 PRIOR ART
FIG. 12 is a family of graphs of coil pattern vs. spindle displacement for a non-sinusoidal traverse pattern (30 (sinusoid) −120 (linear) −30 (sinusoid)

However, in practice the coil patterns are not always sinusoidal because the traverse output is not always sinusoidal. For example, starting from one end of the traverse motion, one currently used traverse pattern is sinusoidal for 30 degrees, linear for 120 degrees, and sinusoidal for 30 degrees. This pattern is then repeated for the return of the traverse. FIG. 12 shows such a pattern as traverse displacement in degrees. The resulting coil patterns are shown for coil radii from 4 inches to 9 inches. The patterns of FIG. 12 were actually calculated using a computer simulation. The horizontal axis represents the displacement of the traverse in degrees. If the slope of the curves is taken from the graph at each diameter as it passes through the horizontal axis, the angle a can be found by using the curve corresponding to the diameter/radius of the coil.

The following equations are applicable for the non-sinusoidal traverse pattern:

Given Po and D, the diameter of the mandrel at the start of the coil:

L=360 PoD and H=(½) L, then (EQ 6) cos (a)=r/h=2r/L and r=L cos (a)/2={360 PoD cos (a)}/2=180 PoD Cos (a) and let Ko=D Cos (a)

Therefore: r=180 KoP (N.B.) Ko can be "looked up", since D is the diameter of the mandrel.

Once r is known, L can be calculated and therefore P can be calculated.

P is calculated as follows: P=360L/ D and from (EQ 6): Cos (a)=2r/L L=2r/cos (a) and (EQ 7) P=360×2r/ D Cos (a)=720r/ D Cos (a)

Let Ko=D Cos (a), therefore: P=720r/Ko

For instance, to determine the angle a for a 9 inch radius coil, the spindle moves through 51 degrees as the gain of the coil changes from +1 to −1. For a 4 inch radius coil, the spindle movement is 66 degrees. This represents angles for a of 14.02 and 23.46 degrees, respectively. The calculations are as follows with reference to FIG. 12:

At a 4 inch radius coil (8 inch diameter), $S_o$=66 degrees; where $S_o$ is the spindle displacement.

The circumference is: $C_4$=66/360×8π=4.608 inches

The coil displacement pattern is 2 inches (+/−1 inch)

At a 9 inch radius coil (diameter 18 inches), $S_o$=51 degrees

Figure 13:
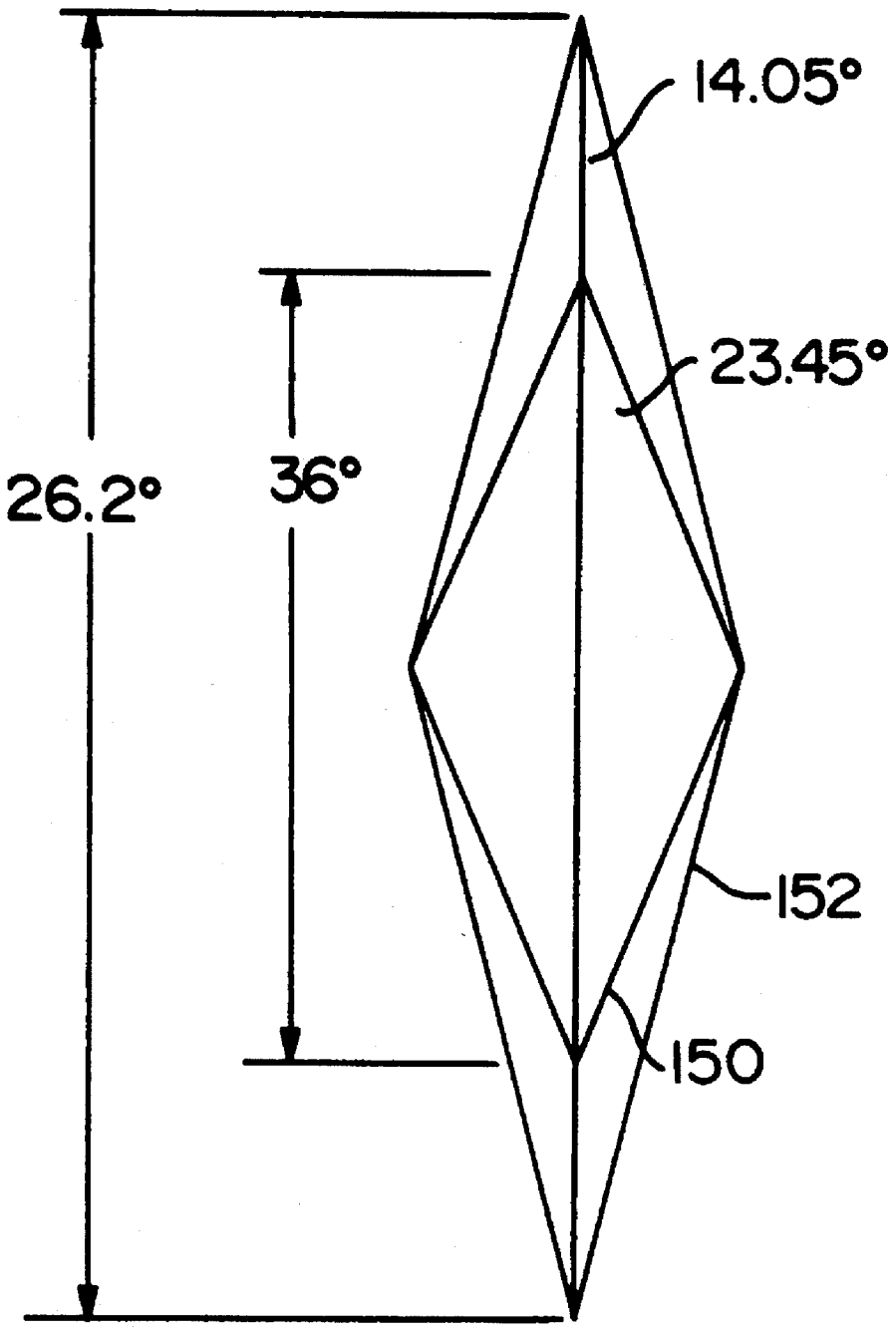
FIG. 13 shows the area around a constant diameter payout hole in accordance with the invention for an 8 inch and an 18 inch diameter wind.

The circumference is: $C_9$=51/360×18π=8.011 Tan $(a)_4$= 4.608/2=23.46 degrees and Tan $(a)_4$=8.011/2=14.02 degrees Using these results for angle (a) and calculating the minimum hole size for the 8 inch diameter and the 18 inch diameter with a 1 inch diameter tube, it is apparent that the payout hole must start with 36 degrees and finish with 26.2 degrees. FIG. 13 shows the area around the payout hole for a coil of 8 inch diameter and 18 inch diameter superimposed upon one another. The hole openings (150 and 152 can be compared to those of FIG. 9. As can be seen, the starting holes are similar, but the final payout holes are quite different. This is because the coil pattern for an 18 inch coil follows the traverse pattern more closely than that of the 8 inch coil. Therefore, the linear portion of the traverse (for 120 degrees through the center) laid out flat on the coil surface almost completely determines the angle (a) for the larger coils. For traverse patterns such as these, the simplest thing to do is to establish a table in the computer memory and have the computer "look up" or interpolate the value of the angle (a') for each payout hole diameter. Once the value of (r') is known, the value of P can be calculated using (EQ 7).

A simple procedure for the above calculation is as follows:

(1) Is START button depressed?
if NO, then go to (1)
(2) D = 8, look up Ko (Ko = 3.14159 × Cos (a) in the table and read Po (hole size thumbwheel)
Calculate r = 180 × Ko × Po (EQ 6)
B = 0 (how much to shrink the hole on each side)
(3) Start winding apparatus (enable interrupts, inputs, etc., disable start, etc.
(4) Is STOP button depressed?
if NO, go to (4)

Part of the algorithm for producing the coil might contain the following process:

(1) Is a layer finished?
If NO, then go to (3)
(2) Look up Ko for new coil diameter
Calculate P = 720 × r/Ko
Calculate B = (Po − P)/2 (how much to shrink the payout hole on each side)
(3) Remainder of the REELEX coil algorithm. . .

The following Table is a "look-up" chart for use with the invention, and in particular the embodiment of FIG. 7, and which shows the relationship between (1) the coil diameter; (2) the value of Ko; (3) the value of angle a'; and (4) the relative location in the ROM or RAM of the computer memory 122 of the winding control circuity of FIG. 7. The concept of the use of such a "Look-up" Table is simply that the processor in effect moves a pointer down the rows of the Table after each layer is wound and uses the information in that column (location) as the value of Ko. In such an instance, the numbers in columns 1–3 of the "look-up" Table would not be necessary. However, such information appears in the Table for purposes of clarity in describing the operation of the invention.

The aforementioned discussion then leads to an alternative manner of obtaining the necessary information, namely programming the processor to solve the necessary equations described above in real time. This is possible because, for example, the curves of FIG. 12 could be calculated for each diameter in real time, thereby making interpolation unnecessary.

Coils produced using the methods of payout hole formation described herein show an overall reduction in diameter of an inch or more for 18 inch coils wound on an 8 inch mandrel. This more than the 7% as previously stated, but, as predicted, the coils were also less "lumpy".

It will be apparent to those skilled in the art that the method and apparatus described herein may be modified with regard to the components described herein without departing from the spirit and scope of the invention which is not to be limited to the specific components and method described herein but the scope of which is to be determined by the claims appended hereto and the equivalents to be entitled to the components thereof.

| (1) Loc | (2) Dia | (3) a | (4) Ko |
|---|---|---|---|
| 1 | 8.00 | 23.46 | 23.05 |
| 2 | 8.20 | 23.17 | 23.68 |
| 3 | 8.40 | 22.90 | 24.31 |

-continued

| (1) Loc | (2) Dia | (3) a | (4) Ko |
|---|---|---|---|
| 4 | 8.60 | 22.64 | 24.94 |
| 5 | 8.80 | 22.40 | 25.56 |
| 6 | 9.00 | 22.17 | 26.18 |
| 7 | 9.20 | 21.95 | 26.81 |
| 8 | 9.40 | 21.75 | 27.43 |
| 9 | 9.60 | 21.57 | 28.05 |
| 10 | 9.80 | 21.39 | 28.67 |
| 11 | 10.00 | 21.23 | 29.28 |
| 12 | 10.20 | 20.98 | 29.92 |
| 13 | 10.40 | 20.74 | 30.56 |
| 14 | 10.60 | 20.51 | 31.19 |
| 15 | 10.80 | 20.29 | 31.82 |
| 16 | 11.00 | 20.08 | 32.46 |
| 17 | 11.20 | 19.88 | 33.09 |
| 18 | 11.40 | 19.68 | 33.72 |
| 19 | 11.60 | 19.50 | 34.35 |
| 20 | 11.80 | 19.32 | 34.98 |
| 21 | 12.00 | 19.15 | 35.61 |
| 22 | 12.20 | 18.89 | 36.26 |
| 23 | 12.40 | 18.64 | 36.91 |
| 24 | 12.60 | 18.39 | 37.56 |
| 25 | 12.80 | 18.16 | 38.21 |
| 26 | 13.00 | 17.93 | 38.86 |
| 27 | 13.20 | 17.70 | 39.51 |
| 28 | 13.40 | 17.48 | 40.15 |
| 29 | 13.60 | 17.27 | 40.80 |
| 30 | 13.80 | 17.07 | 41.45 |
| 31 | 14.00 | 16.86 | 42.09 |
| 32 | 14.20 | 16.67 | 42.74 |
| 33 | 14.40 | 16.48 | 43.38 |
| 34 | 14.60 | 16.29 | 44.02 |
| 35 | 14.80 | 16.11 | 44.67 |
| 36 | 15.00 | 15.94 | 45.31 |
| 37 | 15.20 | 15.77 | 45.96 |
| 38 | 15.40 | 15.60 | 46.60 |
| 39 | 15.60 | 15.44 | 47.24 |
| 40 | 15.80 | 15.28 | 47.88 |
| 41 | 16.00 | 15.12 | 48.52 |
| 42 | 16.20 | 14.95 | 49.17 |
| 43 | 16.40 | 14.77 | 49.82 |
| 44 | 16.60 | 14.60 | 50.47 |
| 45 | 16.80 | 14.43 | 51.11 |
| 46 | 17.00 | 14.27 | 51.76 |
| 47 | 17.20 | 14.11 | 52.40 |
| 48 | 17.40 | 13.96 | 53.05 |
| 49 | 17.60 | 13.80 | 53.70 |
| 50 | 17.80 | 13.65 | 54.34 |
| 51 | 18.00 | 13.51 | 54.98 |

What is claimed is:

1. Apparatus for winding filamentary material, comprising:

a mandrel rotatable about a spindle axis of rotation and a traverse reciprocating at a fixed distance with respect to said spindle axis to wind said filamentary material in a figure 8 coil configuration with a payout hole extending radially from the inner to the outer wind of said coil;

means for controlling the rotation of said mandrel about said spindle axis of rotation; and means for controlling the reciprocating movement of said traverse with respect to the rotation of said mandrel to wind said filamentary material on said mandrel in said coil of a figure 8 configuration to form said radial payout hole having a substantially constant diameter.

2. Apparatus for winding filamentary material as claimed in claim 1, wherein said means for controlling the rotation of said mandrel includes first sensor means for detecting the rotation of said mandrel and second sensor means for detecting the movement of said traverse, means responsive to said first and second sensor means for determining the relative movement of said traverse and the relative rotation of said mandrel with respect to one another and further determining that the relative speed of said traverse with respect to the rotation of said mandrel must be changed to form said substantially constant diameter radial payout hole.

3. Apparatus for winding filamentary material as claimed in claim 2, wherein said means for detecting includes first means for providing a detection window varying in accordance with the desired diameter of said payout hole and responsive to said first sensor control means for providing a first output representative of a fixed rotation of said mandrel, and second means responsive to said second sensor control means for providing a second output representing a fixed movement of said traverse, said means for controlling further including means for determining the coincidence of said first and second outputs, and said means for controlling the reciprocating movement of said traverse being responsive to said means for determining the coincidence for advancing or retarding the gain of the coil winding by controlling the speed of the traverse.

4. Apparatus for winding filamentary material as claimed in claim 3, wherein said first means for providing a detection window further includes a sequencing relay for selecting the size of said payout hole and a sequencing relay coil responsive to said means for determining the coincidence to control said sequencing relay to maintain the diameter of said payout hole during winding of said filamentary material.

5. Apparatus for winding filamentary material as claimed in claim 1, wherein said means for controlling the rotation of said mandrel includes first sensor means for detecting the rotation of said mandrel and second sensor means for detecting the movement of said traverse and at least one of said first or second sensor control means are movable with respect to the rotation of said mandrel or the movement of said traverse, respectively, means responsive to said first and second sensor means for determining the relative movement of said traverse and the relative rotation of said mandrel with respect to one another and further determining that the relative speed of said traverse with respect to the rotation of said mandrel must be changed to form said substantially constant diameter radial payout hole.

6. Apparatus for winding filamentary material as claimed in claim 5, wherein said means for determining includes first means for providing a detection window varying in accordance with the desired diameter of said payout hole and responsive to said first sensor means for providing a first output representative of a fixed rotation of said mandrel, and second means responsive to said second sensor means for providing a second output representing a fixed movement of said traverse, said means for controlling the rotation of said mandrel further including means for determining the coincidence of said first and second outputs, and said means for controlling the reciprocating movement of said traverse being responsive to said means for determining the coincidence for advancing or retarding the gain of the coil winding by controlling the speed of the traverse.

7. Apparatus for winding filamentary material as claimed in claim 6, further comprising means for moving said at least one of said first or second sensor means, and wherein said first means for providing a detection window further includes means for selecting the size of said payout hole and responsive to said means for determining the coincidence to vary the diameter of said payout hole by movement of said first or second sensor means.

8. Apparatus for winding filamentary material as claimed in claim 1, wherein said means for controlling includes first sensor encoder means for detecting the rotation of said mandrel and second sensor encoder means for detecting the movement of said traverse, counter means responsive to said first and second sensor encoder means for determining the relative movement of said traverse and the relative rotation of said mandrel with respect to one another and further determining that the relative speed of said traverse with respect to the rotation of said mandrel must be changed to form said substantially constant diameter radial payout hole.

9. Apparatus for winding filamentary material as claimed in claim 8, wherein said means for determining further includes microprocessor means responsive to said first sensor encoder means for providing a first output representative of a fixed rotation of said mandrel and to said second sensor encoder means for providing a second output representing a fixed movement of said traverse, said microprocessor means determining the coincidence of said first and second outputs, and said means for controlling the reciprocating movement of said traverse being responsive to said microprocessor means advancing or retarding the gain of the coil winding by controlling the speed of the traverse.

10. A method for winding filamentary material on a mandrel rotatable about a spindle axis of rotation and a traverse reciprocating at a fixed distance with respect to said spindle axis to wind said filamentary material in a figure 8 coil configuration with a radial payout hole extending radially from the inner to the outer wind of said coil, comprising the steps of:

controlling the rotation of said mandrel about said spindle axis of rotation; and controlling the reciprocating movement of said traverse with respect to the rotation of said mandrel to wind said filamentary material on said mandrel to form said radial payout hole having a substantially constant diameter.

11. The method for winding filamentary material as claimed in claim 10, wherein said steps of controlling include detecting the rotation of said mandrel and detecting the movement of said traverse, detecting the relative movement of said traverse and the relative rotation of said mandrel with respect to one another from said step of detecting and determining that the relative speed of said traverse with respect to the rotation of said mandrel must be changed to form said substantially constant diameter radial payout hole.

12. The method for winding filamentary material as claimed in claim 11, wherein said step of detecting includes providing a detection window varying in accordance with the desired diameter of said payout hole and providing a first output representative of a fixed rotation of said mandrel, and providing a second output representing a fixed movement of said traverse, said step of controlling further including determining the coincidence of said first and second outputs, and said step of controlling the reciprocating movement of said traverse being responsive to said step of determining the coincidence for advancing or retarding the gain of the coil winding by controlling the speed of the traverse to maintain the selected diameter of said payout hole.

13. The method for winding filamentary material as claimed in claim 12, wherein said step of providing a detection window further includes selecting the size of said payout hole.

14. The method for winding filamentary material as claimed in claim 10, wherein said step of controlling includes the step of detecting the rotation of said mandrel by first sensor means and the step of detecting the movement of said traverse by second sensor means, and at least one of said first or second sensor means being movable with respect to the rotation of said mandrel or the movement of said traverse, respectively, and further including the step of detecting the relative movement of said traverse and the relative rotation of said mandrel indicating that the relative speed of said traverse with respect to the rotation of said mandrel must be changed to form said substantially constant diameter radial payout hole.

15. The method for winding filamentary material as claimed in claim 14, wherein said step of detecting includes providing a first output representative of a fixed rotation of said mandrel and providing a second output representing a fixed movement of said traverse, determining the coincidence of said first and second outputs, and advancing or retarding the gain of the coil winding by controlling the speed of the traverse to maintain the diameter of said payout hole.

16. The method for winding filamentary material as claimed in claim 15, further comprising the step of moving said at least one of said first or second sensor means, and selecting the size of said payout hole and maintaining the diameter of said payout hole by movement of said first or second sensor means.

* * * * *